US007367470B2

(12) United States Patent
Cittadino et al.

(10) Patent No.: US 7,367,470 B2
(45) Date of Patent: May 6, 2008

(54) MULTI-POSTURE FOLDED TOWEL DISPENSER

(75) Inventors: Antonio M. Cittadino, Appleton, WI (US); Scott M. Kouri, Long Grove, IL (US); Richard J. Page, Lake Villa, IL (US); Jean E. Kiple, Lake Villa, IL (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 273 days.

(21) Appl. No.: 11/229,943

(22) Filed: Sep. 19, 2005

(65) Prior Publication Data

US 2007/0062969 A1 Mar. 22, 2007

(51) Int. Cl.
*B65H 3/00* (2006.01)

(52) U.S. Cl. ..... 221/41; 221/33; 221/38; 221/45; 221/61; 221/62

(58) Field of Classification Search ..... 221/33, 221/38, 41, 61, 45, 62
See application file for complete search history.

(56) References Cited

U.S. PATENT DOCUMENTS 1,754,467 A * 4/1930 Hothersall ..... 221/53
2,475,657 A 7/1949 Braley
3,068,055 A * 12/1962 Lenzi et al. ..... 312/50
3,203,586 A 8/1965 Downham
3,307,740 A 3/1967 Fant
4,155,484 A * 5/1979 Pastore ..... 221/35
4,724,974 A * 2/1988 Marqua et al. ..... 221/59
4,953,747 A 9/1990 Wenkman et al.
5,090,592 A 2/1992 Petterson et al.
D427,468 S 7/2000 Morand
6,116,534 A 9/2000 Morand
6,286,713 B1 9/2001 Chan et al.
6,378,726 B1 4/2002 Chan et al.
6,585,129 B2 7/2003 Moody et al.
6,824,007 B2 11/2004 Timmers et al.
6,929,147 B2 8/2005 Guillemette et al.
2004/0026440 A1 2/2004 Kruchoski et al.
2005/0150898 A1 7/2005 Young et al.
2005/0199643 A1 9/2005 Smiley et al.

* cited by examiner

*Primary Examiner*—Gene O. Crawford
*Assistant Examiner*—Timothy R Waggoner

(57) ABSTRACT

A free-standing dispenser for inter-folded towels capable of being placed in a wide variety of postures having an opening which facilitates one handed dispensing.

27 Claims, 8 Drawing Sheets

38

26
δ
γ
51
46
36
42
50
51
SECTION 4 - 4
34

MULTI-POSTURE FOLDED TOWEL DISPENSER

Disposable toweling for home use has been widely sold in the form of rolls of perforated toweling, commonly referred to as kitchen roll towel. While roll toweling is extremely economical and easily manufactured, dispensers for kitchen roll towel are usually distinctly utilitarian and lacking in aesthetic appeal, even if made of relatively high-cost materials such as stainless steel, brass or wood. Further, such dispensers are normally either mounted to a wall or provided with a heavy base to provide the resistance required to enable the user to separate a towel from the remainder of the roll with a single hand without tipping. This invention is directed to a toweling system comprising a dispenser and folded toweling therefor which needs neither to be fixed to a wall nor to incorporate a heavy base but rather may be easily placed in any of a wide variety of postures while retaining the ability for the user to single-handedly obtain a single towel.

The dispenser of the present toweling system comprises a generally prismatic housing having resilient protuberate peripheral plinths formed at opposed ends thereof. A hinged cambered access panel having an interiorly projecting (downwardly projecting when the access panel is uppermost) incurvate lip is rotatable between a closed position and an open position providing access to the interior, the incurvate lip being located away from the hinge and being at least partially overlapped by a cambered panel having an access concavity formed therein, the interiorly projecting incurvate lip being inwardly spaced from the panel with a biconvex lenticulate slot therebetween defining an opening through which toweling may be removed. Preferably, the concavity is formed along an edge on a minor lateral face of said prism closely adjacent to said interiorly projecting incurvate lip, while a spring engaging a backing plate is provided to urge a stack of toweling between the cambered panel and backing plate within said housing toward the slot. In more preferred embodiments, four exterior panels forming the lateral faces of the prismatic housing camber outwardly while the interiorly projecting incurvate lip bows inwardly so that, when viewed in section, the slot defined between the downwardly projecting incurvate lip and the outwardly cambered panel adjacent thereto presents a biconvex lenticulate shape being wider near its center than at either of its outward termini when viewed in section.

DESCRIPTION OF THE PREFERRED EMBODIMENT

Figure 1:
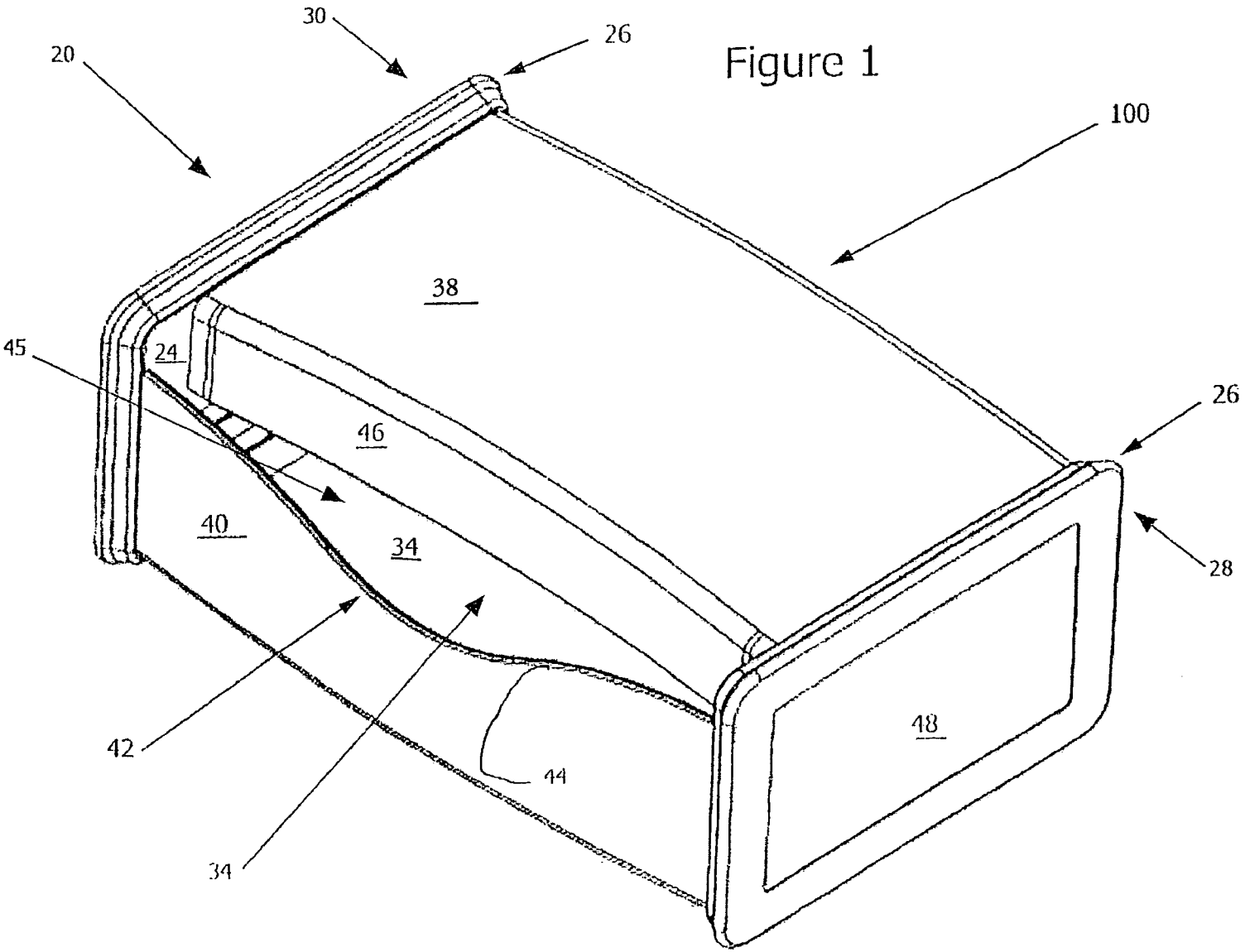
FIG. 1 is a schematic perspective view of the dispenser of the present invention particularly illustrating the dispensing slot and the opposed resilient protuberate peripheral plinths enabling the dispenser to be conveniently disposed in a wide variety of postures.
Figure 2:
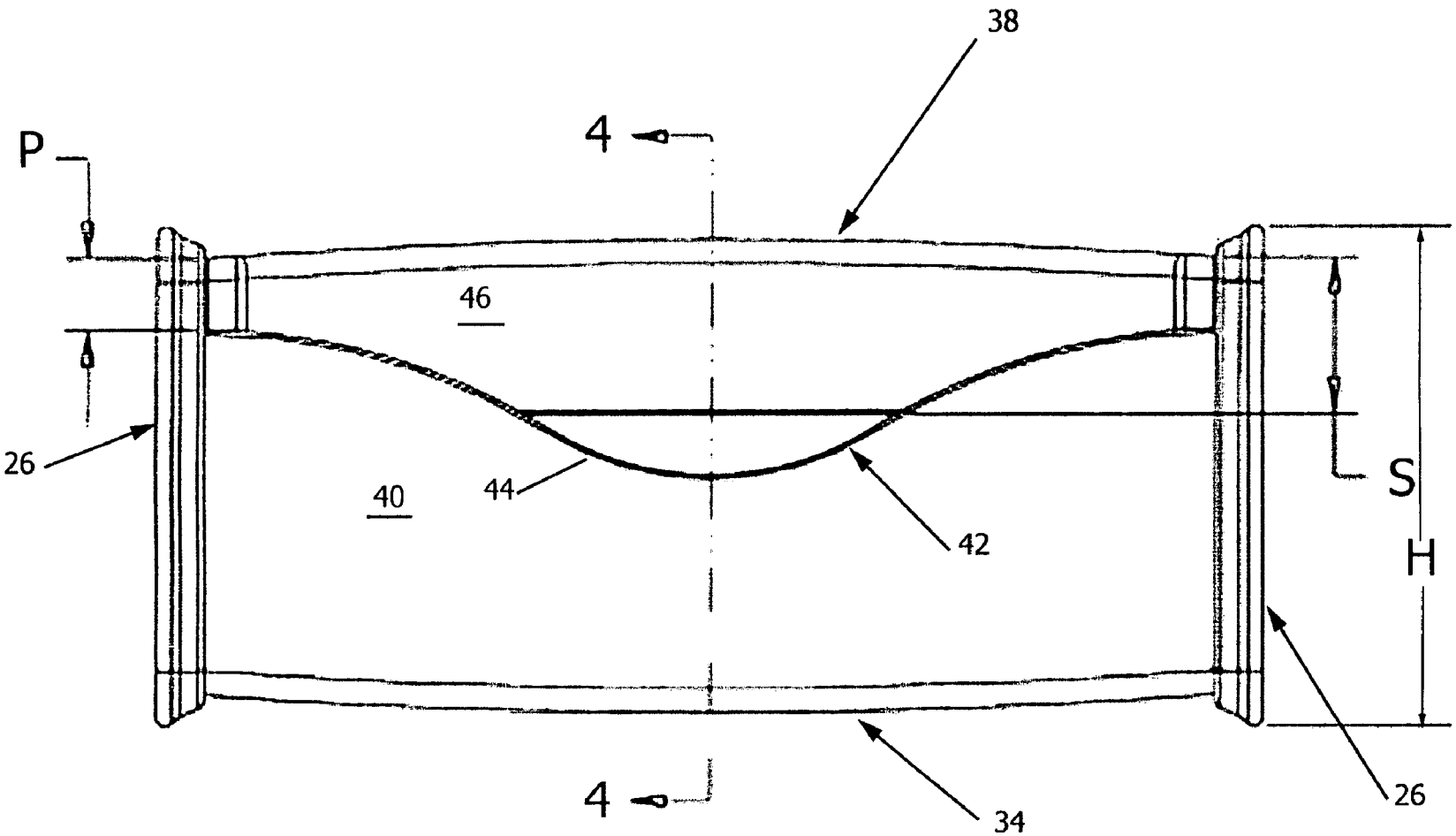
FIG. 2 is a front elevation of the dispenser illustrating the dispensing opening therein.
Figure 3:
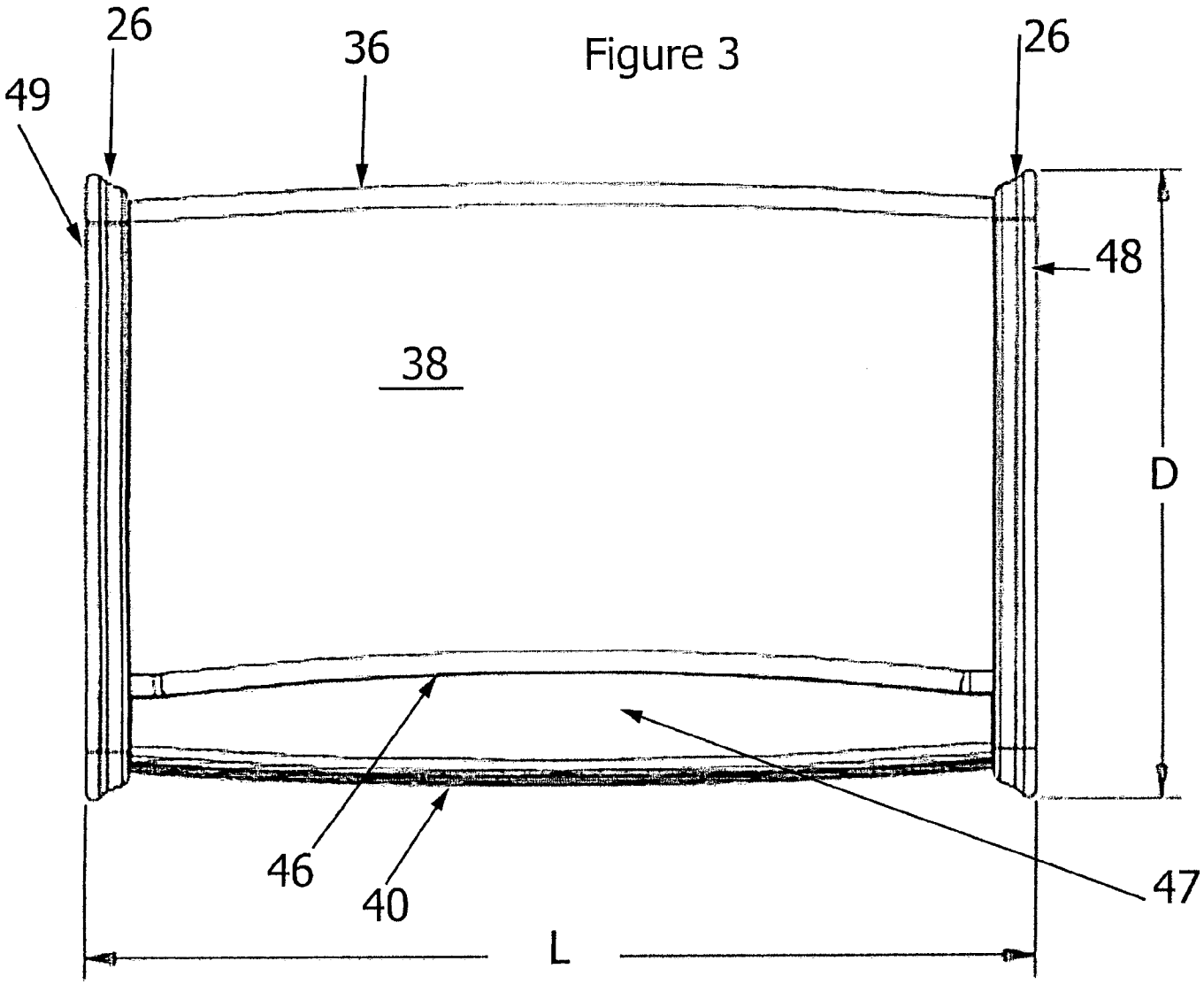
FIG. 3 is a top view of the dispenser illustrating the slot having a bi-convex lenticulate section through which toweling may be withdrawn.

In FIGS. 1-5, dispenser 100 comprises generally prismatic housing 20 defined between end panels 22 and 24 bearing resilient protuberate peripheral plinths 26 formed at opposed ends 28 and 30 of generally prismatic housing 20. Storage cavity 32 is defined among: (i) fixed outwardly cambered major lateral panel 34; (ii) minor lateral panel 36; (iii) outwardly cambered access panel 38 hingedly connected to end panels 22 and 24; and (iv) cambered minor lateral panel 40 having concavity 42 formed along edge 44 thereof. Dispensing aperture 45 is defined by slot 47 between (i) cambered minor lateral panel 40 having concavity 42 formed along edge 44 thereof and (ii) interiorly projecting incurvate lip 46 adjoining outwardly cambered access panel 38 hingedly connected to end panels 22 and 24 , each of which is, as previously mentioned, encompassed by resilient protuberate peripheral plinth 26. Resilient protuberate peripheral plinths 26 not only project laterally beyond, but also project longitudinally beyond the end panels 22 and 24, thereby defining recesses 48 and 49, so that dispenser 100 may be positioned on a flat surface in a wide variety of postures including:

- that illustrated in FIG. 1 in which fixed outwardly cambered major panel 34 is disposed horizontally beneath outwardly cambered access panel 38; or
- with either of recessed end panels 22 or 24 placed horizontally below the other end panel; or
- with outwardly cambered minor lateral panel 36 horizontal and beneath outwardly cambered minor lateral panel 40.

Accordingly, it can be appreciated that dispenser 100 can be disposed in a wide variety of postures on an available horizontal surface according to the user's space available, aesthetic urges or whims, yet stably rest upon resilient protuberate peripheral plinths 26 without incurring marring contact between the supporting surface and either of end panels 22 or 24 or any of the outwardly cambered lateral panels 34, 36, 38, or 40. Thus, the dispenser may be stably placed for dispensing upwardly, forwardly or sideways with either hand depending upon the posture chosen by the user while avoiding contact which might mar either the surface upon which the dispenser rests or any of the panels of the dispensers.

Figure 4:
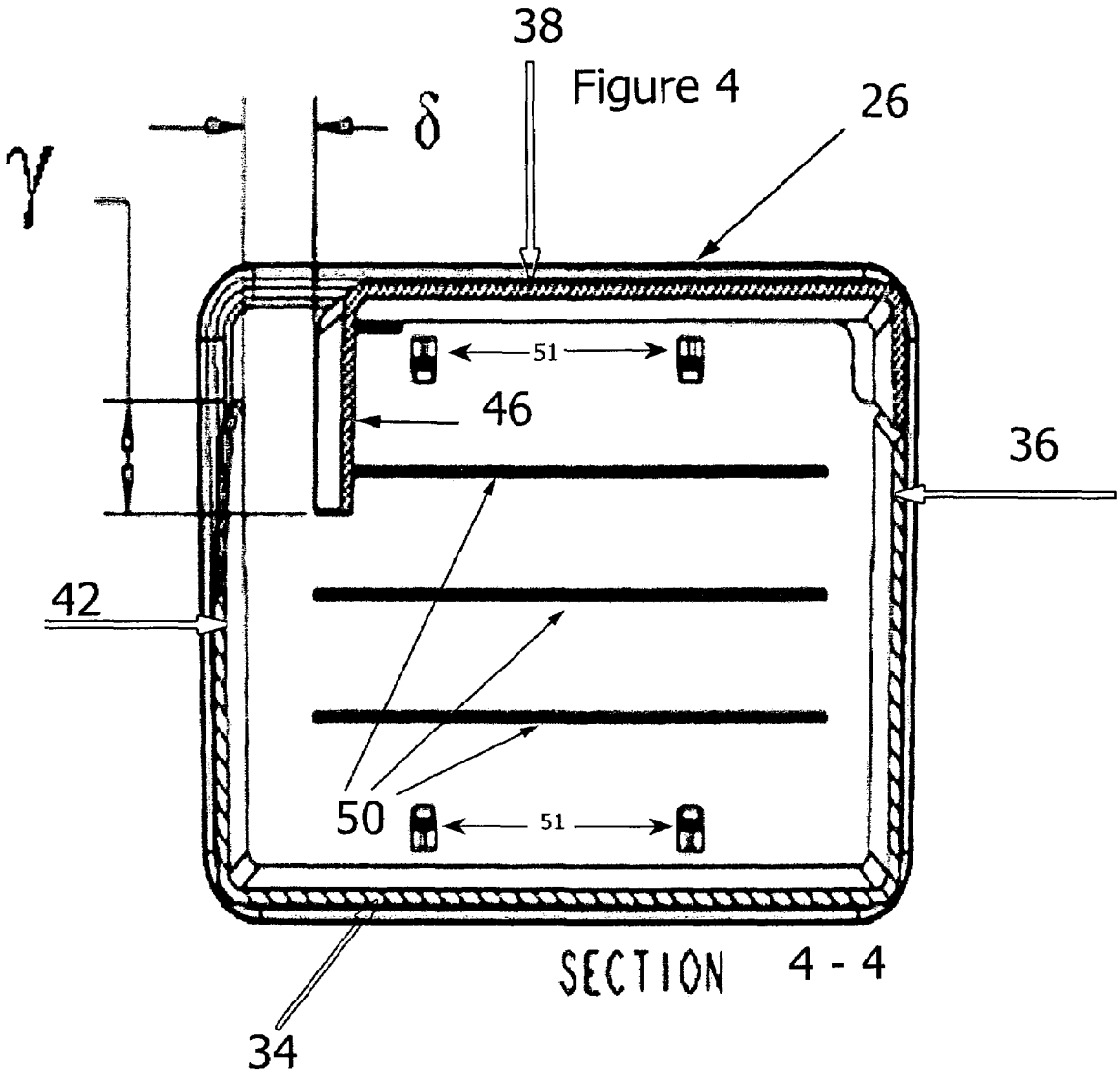
FIG. 4 is a sectional view along lines 4-4 of FIG. 2 illustrating the partial overlap between the interiorly projecting incurvate lip of the cambered access panel of the dispenser and the outwardly cambered minor lateral panel adjacent thereto.
Figure 5:
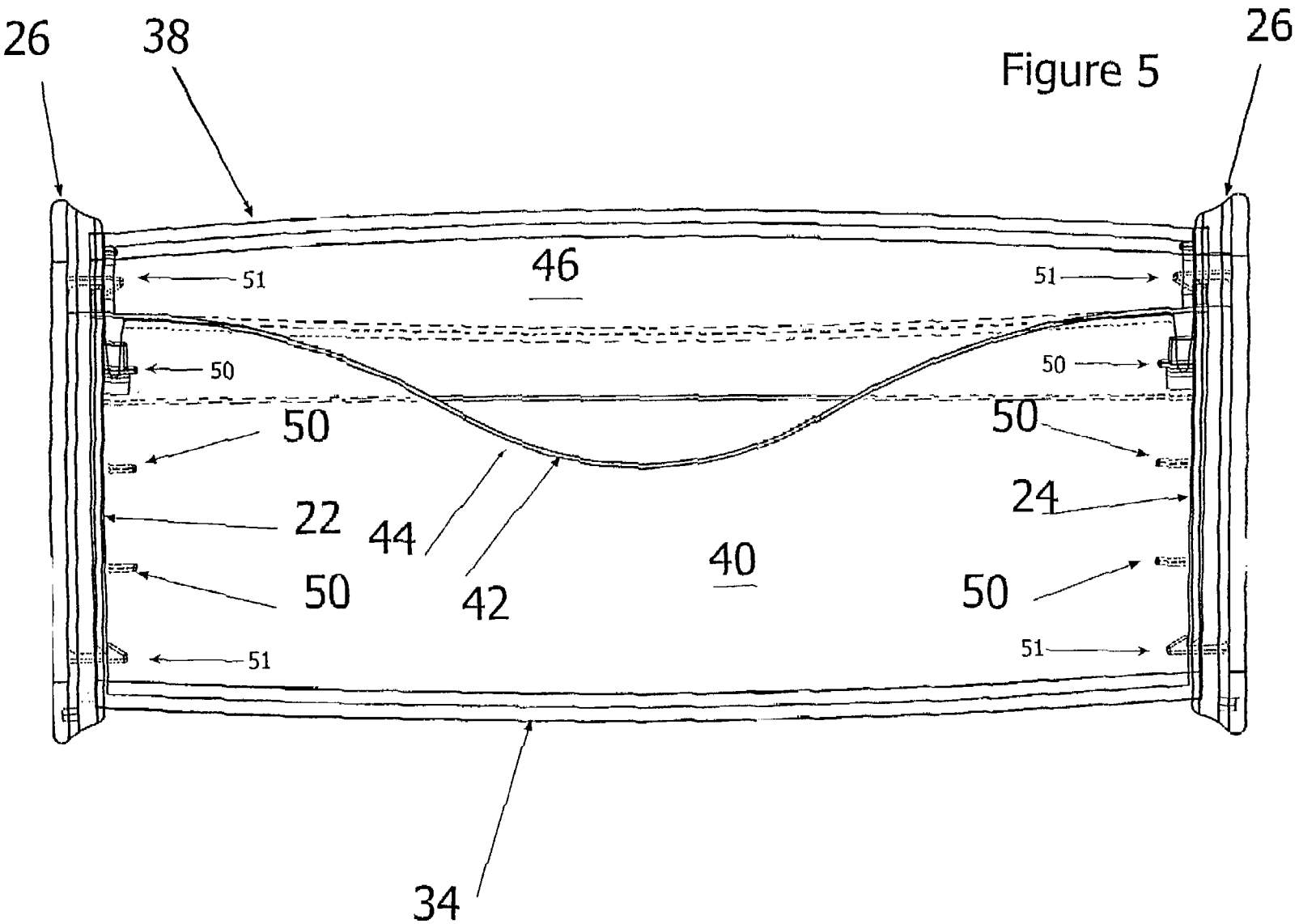
FIG. 5 is another front elevation of the dispenser illustrating with hidden lines the cooperation between various features of the dispenser.

As illustrated in FIGS. 4 and 5, longitudinally extending ribs 50 project inwardly from end panels 22 and 24 providing clearance around flexible locking pins 51 securing end panels 22 and 24 to resilient protuberate plinths 26 thereby alleviating potential interference between flexible locking pins 51 and toweling stack 64 disposed within storage cavity 32.

Preferably, interiorly projecting incurvate lip 46 is spaced inwardly by a distance "δ" from outwardly cambered minor lateral panel 40 of from about 0.5 to about 1 in., most preferably 730 mils, along the center line of dispenser 100 while interiorly projecting incurvate lip 46 projects below outwardly cambered access panel 38 by a distance "S" of approximately 1.5" to 1.75", most preferably 1.63" below. Preferably, if slot 47 has a width of 10.5", incurvate lip 46 is only very gently curved, having a radius of curvature lying in the horizontal plane of approximately 45". Inasmuch as incurvate lip 46 is curved inwardly while minor lateral panel 40 is cambered outwardly, dispensing aperture 45 when viewed in plan view has a generally biconvex lenticulate shape.

Figure 7:
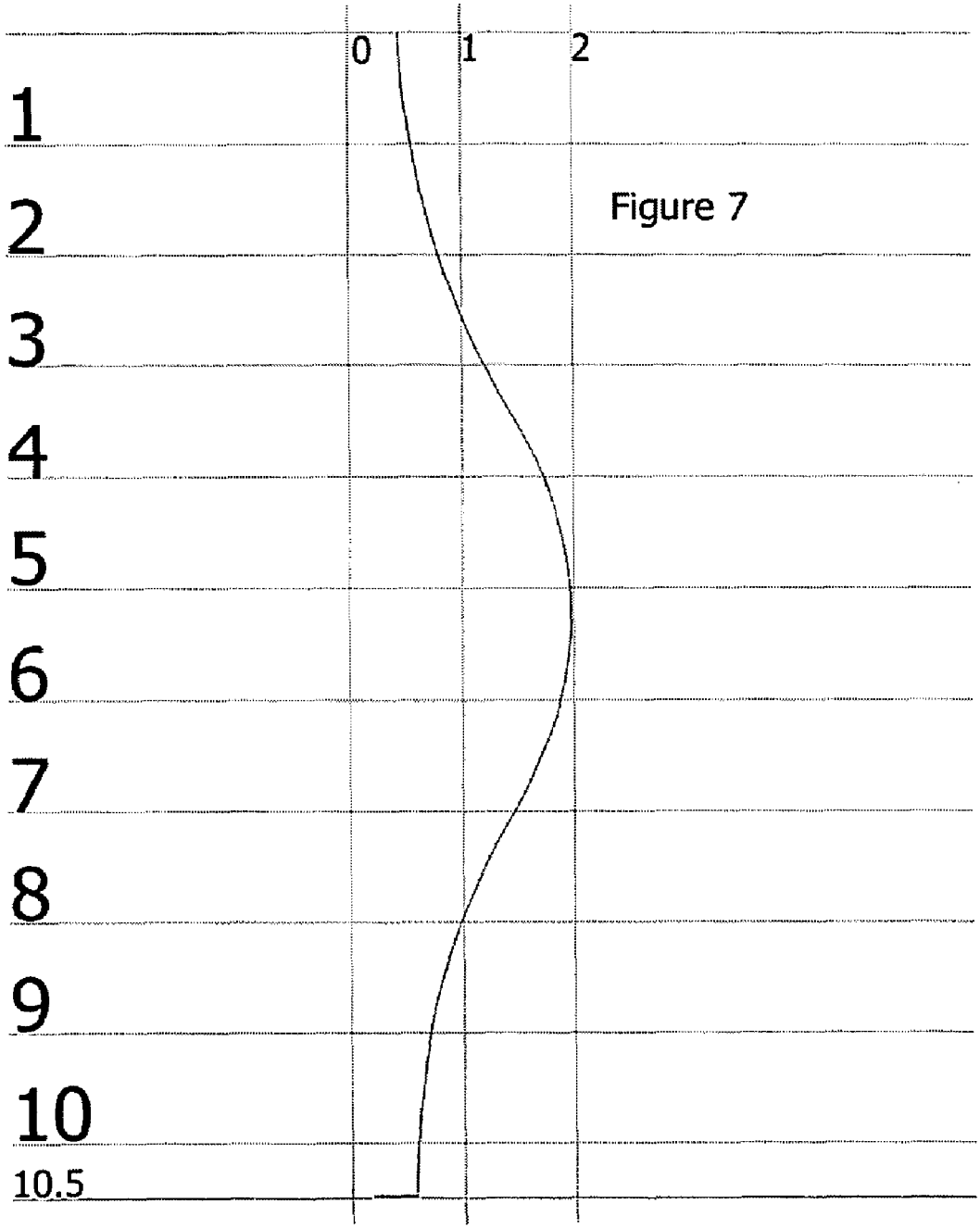
FIG. 7 is a scale drawing of a portion of the concavity shape of the most preferred dispensing aperture of the dispenser of the present invention.

We have found that it is particularly beneficial to dispensing if concavity 42 in cambered minor lateral panel 40 has a shape closely conforming to that shown in FIG. 7 with the outer extremities of concavity 42 being spaced a distance "P" of approximately ⅝" to ⅞" below, most preferably ¾" below, outwardly cambered access panel 38 and the center line being spaced further downwardly about 1 ½ in. (37 mm) as illustrated in the scale drawing of FIG. 7, the overlap "γ" between interiorly projecting incurvate lip 46 and cambered minor lateral panel 40 therefore being approximately 880 mils with the center line of concavity 42 therefore being approximately 2 ¼ inches below outwardly cambered access panel 38 when the most preferred dimensions are selected. Table 1 sets forth the approximate shape of concavity 42 as a function of the distance from its centerline, concavity 42 being preferably bilaterally symmetrical. Still more preferably, the upper portion (about ¾" to 1") of cambered minor lateral panel 40 is inclined inwardly at between 5° and 15° from the vertical.

TABLE 1

Depth of Concavity (mm) as a function of Distance from Centerline (cm)

| | cm from Center | | | | | | | | | | | | | |
|---|---|---|---|---|---|---|---|---|---|---|---|---|---|---|
| | 0 | 1 | 2 | 3 | 4 | 5 | 6 | 7 | 8 | 9 | 10 | 11 | 12 | 13 |
| Depth (mm) | 37 | 36 | 34 | 31 | 26 | 21.5 | 16 | 12 | 8 | 5 | 4 | 2 | 1 | 0 |

Plinths 26 may be formed from thermoplastic elastomers, thermoplastic olefins, thermoplastic vulcanizates, silicone rubber, or polyurethane. Typically, we prefer that plinths 26 have a hardness of between 15 and 90 as measured on the Shore A scale. The degree polymerization of plinths 26 should be controlled such that the polymer is non-marking. The remainder of the body of dispenser 100 may be formed by injection molding, thermoforming or any other convenient method. Preferably, the panels will be injection molded from ABS copolymer-poly(acrylonitrile, butadiene, styrene), polystyrene, polypropylene, polyvinyl chloride or any other convenient engineering resin.

Toweling for the present dispenser system preferably comprises two-ply through air dried product in the Z-fold configuration with the overall unfolded sheet size being 9¼" by 11" with a folded sheet size of 9 ¼" by 3⅝". Owing to the vagaries of sheet stacking, a 60 count stack of 31lb. toweling will typically have a gross size of 9 ¼"×3¾"×4¼". Such toweling is far more easily dispensed single-handedly when the dispensing aperture is configured as described above using the preferred dimensions. Such toweling will preferably have a caliper of between 160 and 210 mils/8 sheets measured under a load of 540 g. The CD wet tensile is preferably at least about 440 g/3" measured by the Finch cup method for ease in dispensing with wet hands.

Figure 6:
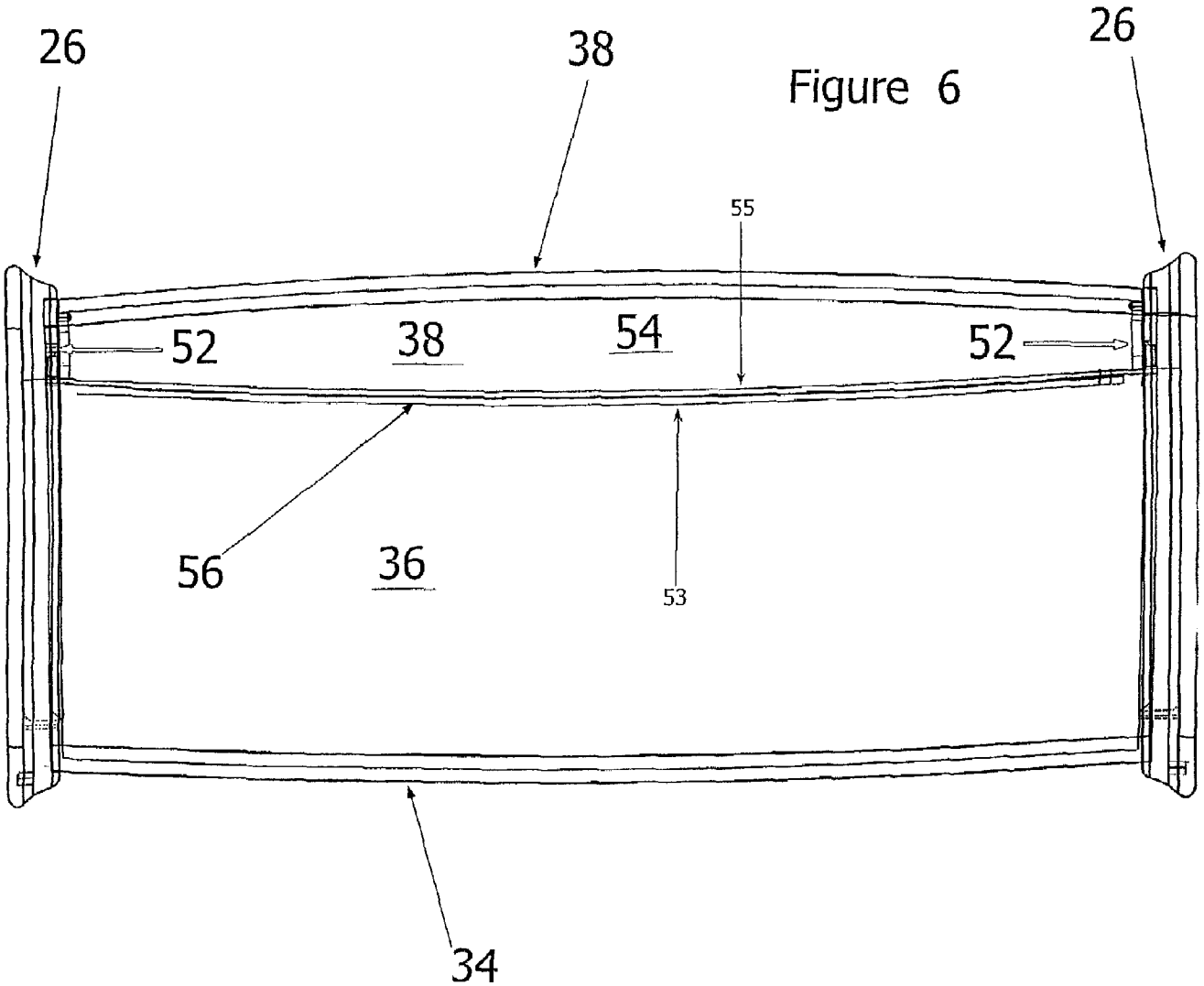
FIG. 6 is a rear elevation of the dispenser.
Figure 8:
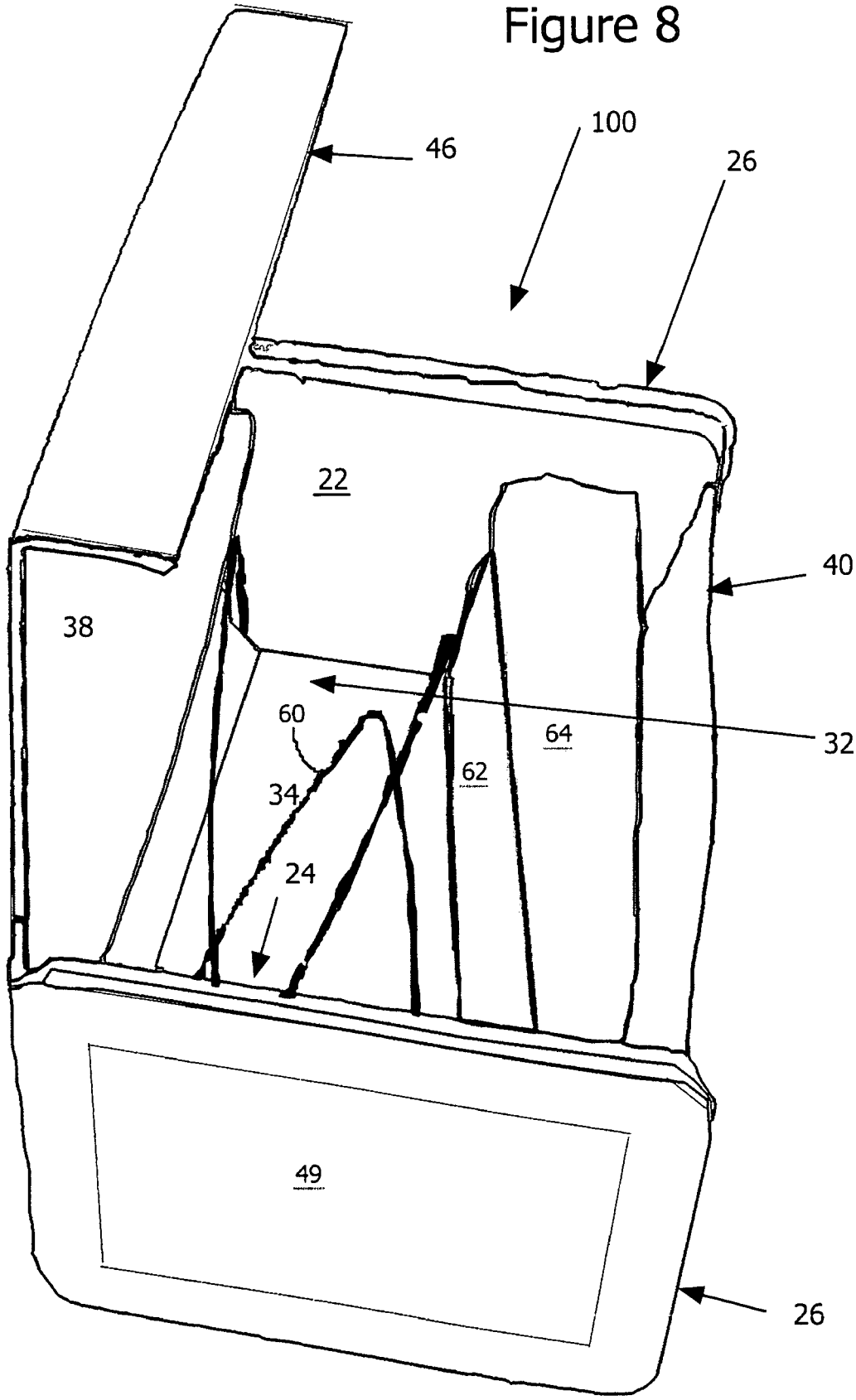
FIG. 8 is a perspective illustrating the dispenser in an opened configuration with a spring pressing against a backing plate and urging a stack of toweling toward the outwardly cambered minor lateral panel.

FIG. 6 illustrates the rear of the dispensing system of the present invention with hinge pins 52 extending from outwardly cambered major lateral access panel 38 to end plates 22 and 24 behind plinths 26 so that outwardly cambered major lateral access panel 38 may be pivoted between the closed position shown in FIGS. 1-6 and the open position illustrated in FIG. 8. Clearance slot 56 in FIG. 6 is defined between chamfered edge 55 of downwardly projecting rear lip 54 of outwardly cambered lateral access panel 38 and chamfered edge 53 of minor lateral panel 36 so that access panel 38 may be rotated upwardly about hinge pins 52 as shown in FIG. 8 illustrating the dispensing system of the present invention with outwardly cambered hinged access panel 38 open revealing spring 60 bearing against back plate 62 urging toweling pack 64 against outwardly cambered minor lateral panel 40. Preferably spring 60 has a spring constant of from about 0.10 lb/in to 0.15 lb/in.

As our invention, we claim:

1. A dispenser for inter-folded toweling comprising:

a generally prismatic housing having:

i) two laterally opposed end panels;

ii) two major lateral panels extending between and joining said end panels;

iii) two minor lateral panels extending between and joining said end panels; and iv) two resilient protuberate peripheral plinths, each surrounding one of said end panels;

at least one of said lateral panels being hinged and having an interiorly projecting curvate lip adjacent an edge away from the location at which said lateral panel is hinged; and a panel adjoining said interiorly projecting curvate lip having a concavity formed along an edge thereof adjacent and at least partially overlapping said interiorly projecting curvate lip.

2. The dispenser for inter-folded toweling of claim 1, wherein said panel adjoining said interiorly projecting curvate lip is cambered outwardly.

3. The dispenser for inter-folded toweling of claim 2, wherein said interiorly projecting curvate lip is incurvate.

4. The dispenser for inter-folded toweling of claim 3, wherein said lateral panel having an interiorly projecting curvate lip is cambered outwardly.

5. The dispenser for inter-folded toweling of claim 4, wherein each said lateral panel is cambered outwardly.

6. The dispenser for inter-folded toweling of claim 5, further comprising a spring for urging inter-folded towels within said housing toward said interiorly projecting incurvate lip.

7. The dispenser for inter-folded toweling of claim 6, wherein said hinged lateral panel having an interiorly projecting curvate lip is generally "C" shaped in cross-section.

8. The dispenser for inter-folded toweling of claim 7, wherein said panel adjoining said interiorly projecting curvate lip having a concavity formed along an edge thereof adjacent and at least partially overlapping said interiorly projecting curvate lip is spaced outwardly from said interiorly projecting curvate lip.

9. The dispenser for inter-folded toweling of claim 8, wherein a biconvex lenticulate gap is formed between said interiorly projecting curvate lip and said panel adjoining said interiorly projecting curvate lip.

10. The dispenser for inter-folded toweling of claim 1, wherein said interiorly projecting curvate lip is incurvate.

11. The dispenser for inter-folded toweling of claim 1, wherein said lateral panel having an interiorly projecting curvate lip is cambered outwardly.

12. The dispenser for inter-folded toweling of claim 1, wherein each said lateral panel is cambered outwardly.

13. The dispenser for inter-folded toweling of claim 1, further comprising a spring for urging inter-folded towels within said housing toward said interiorly projecting curvate lip.

14. The dispenser for inter-folded toweling of claim 1, wherein a biconvex lenticulate gap is formed between said interiorly projecting curvate lip and said panel adjoining said interiorly projecting curvate lip.

15. The dispenser for inter-folded toweling of claim 1, wherein said hinged lateral panel having an interiorly projecting curvate lip is generally "C" shaped in cross-section.

16. A dispenser for inter-folded toweling comprising:

a generally prismatic housing having:

i) two laterally opposed end panels;

ii) two major lateral panels extending between and joining said end panels; and iii) two minor lateral panels extending between and joining said end panels;

at least one of said lateral panels being hinged and having an interiorly projecting curvate lip adjacent an edge away from the location at which said lateral panel is hinged; and a panel adjoining said interiorly projecting curvate lip having a concavity formed along an edge thereof adjacent and at least partially overlapping said interiorly projecting curvate lip, and wherein a dispensing slot defined between said interiorly projecting curvate lip and a cambered minor lateral panel has a biconvex lenticulate shape.

17. The dispenser for inter-folded toweling of claim 16 wherein said dispensing slot has a width of between 1.10" and 1.30" at its medial point decreasing by from about ⅜" to about ⅝" at its termini.

18. The dispenser for inter-folded toweling of claim 17 wherein said cambered minor lateral panel has a concavity having a central depth of between 2.15" and 2.35" beneath said outwardly cambered access panel tapering to a terminal depth of between 0.625" and 0.875" at both ends thereof.

19. The dispenser for inter-folded toweling of claim 18 wherein:

a. the depth of the concavity at locations spaced 1" inwardly from the termini thereof is between 1/16" and 3/16" greater than the depth at the termini;

b. the depth of the concavity at locations spaced 2" inwardly from the termini thereof is between ¼" and ⅜" greater than the depth at the termini;

c. the depth of the concavity at locations spaced 3" inwardly from the termini thereof is between ⅝" and ¾" greater than the depth at the termini;

d. the depth of the concavity at locations spaced 4" inwardly from the termini thereof is between 1 3/16" and 1 5/16" greater than the depth at the termini; and e. the depth of the concavity at locations spaced 5" or more inwardly from the termini thereof is between 1 7/16" and 1 9/16" greater than the depth at the termini.

20. The dispenser for inter-folded toweling of claim 19 wherein said interiorly projecting curvate lip projects downwardly by a depth of between about 1½" and 1¾" below the outwardly cambered access panel.

21. The dispenser for inter-folded toweling of claim 20 wherein said interiorly projecting curvate lip terminates between about ½" and ¾" above the lowest central point of said concavity in said cambered minor lateral panel.

22. The dispenser for inter-folded toweling of claim 19 wherein said interiorly projecting curvate lip terminates between about ½" and ¾" above the lowest central point of said concavity in said cambered minor lateral panel.

23. The dispenser for inter-folded toweling of claim 16 wherein said cambered minor lateral panel has a concavity having a central depth of between 2.15" and 2.35" beneath said outwardly cambered access panel tapering to a terminal depth of between 0.625" and 0.875" at both ends thereof.

24. The dispenser for inter-folded toweling of claim 16 wherein:

a. the depth of the concavity at locations spaced 1" inwardly from the termini thereof is between 1/16" and 3/16" greater than the depth at the termini;

b. the depth of the concavity at locations spaced 2" inwardly from the termini thereof is between ¼" and ⅜" greater than the depth at the termini;

c. the depth of the concavity at locations spaced 3" inwardly from the termini thereof is between ⅝" and ¾" greater than the depth at the termini;

d. the depth of the concavity at locations spaced 4" inwardly from the termini thereof is between 1 3/16" and 1 5/16" greater than the depth at the termini; and e. the depth of the concavity at locations spaced 5" or more inwardly from the termini thereof is between 1 7/16" and 1 9/16" greater than the depth at the termini.

25. The dispenser for inter-folded toweling of claim 24 wherein said interiorly projecting curvate lip projects downwardly by a depth of between about1½" and 1¾" below the outwardly cambered access panel.

26. The dispenser for inter-folded toweling of claim 25 wherein said interiorly projecting curvate lip terminates between about ½" and ¾" above the lowest central point of said concavity in said cambered minor lateral panel.

27. The dispenser for inter-folded toweling of claim 24 wherein said interiorly projecting curvate lip terminates between about ½" and ¾" above the lowest central point of said concavity in said cambered minor lateral panel.

* * * * *